US010337230B2

(12) United States Patent
Kigoshi et al.

(10) Patent No.: US 10,337,230 B2
(45) Date of Patent: Jul. 2, 2019

(54) CONTROL DEVICE FOR OPENING AND CLOSING BODIES

(71) Applicant: OMRON AUTOMOTIVE ELECTRONICS CO., LTD., Aichi (JP)

(72) Inventors: Katsunori Kigoshi, Guangzhou (CN); Daisuke Ogawa, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 0 days.

(21) Appl. No.: 15/748,677

(22) PCT Filed: Mar. 4, 2016

(86) PCT No.: PCT/JP2016/001188
§ 371 (c)(1),
(2) Date: Jan. 30, 2018

(87) PCT Pub. No.: WO2017/022148
PCT Pub. Date: Feb. 9, 2017

(65) Prior Publication Data

US 2019/0003231 A1 Jan. 3, 2019

(30) Foreign Application Priority Data

Aug. 6, 2015 (JP) ..... 2015-156134

(51) Int. Cl.
*E05F 15/02* (2006.01)
*E05F 15/41* (2015.01)
(Continued)

(52) U.S. Cl.
CPC ..... *E05F 15/41* (2015.01); *E05F 15/689* (2015.01); *E05F 15/695* (2015.01); *E05Y 2400/56* (2013.01); *E05Y 2900/55* (2013.01)

(58) Field of Classification Search
CPC ..... E05F 15/41; E05F 15/695; E05F 2900/55
(Continued)

(56) References Cited

U.S. PATENT DOCUMENTS 5,723,960 A * 3/1998 Harada ..... H02H 7/0851 318/282
5,983,567 A * 11/1999 Mitsuda ..... H02H 7/0851 49/26
(Continued)

FOREIGN PATENT DOCUMENTS

JP 4573992 B2 11/2010
JP 4579757 B2 11/2010
(Continued)

OTHER PUBLICATIONS

International Search Report issued in corresponding application No. PCT/JP2016/001188 dated May 31, 2016 (2 pages).
(Continued)

*Primary Examiner* — Jerry E Redman
(74) *Attorney, Agent, or Firm* — Osha Liang LLP

(57) ABSTRACT

During opening and closing actions of a window glass, the presence or absence of pinching of a foreign object in a window is determined on the basis of an amount of change in the movement speed of the window glass and a threshold value stored in a storage unit, and a drive direction of a motor is reversed in order to release a foreign object if it is determined that pinching is present. A threshold value update unit updates threshold values for pinching determination on the basis of the amount of change in the movement speed of the window glass for specific ranges of an entire movement range of the window glass. In addition, a threshold value for pinching determination for a range other than the specific ranges is set to be a preset fixed value.

5 Claims, 7 Drawing Sheets

(51) Int. Cl.
*E05F 15/689* (2015.01)
*E05F 15/695* (2015.01)

(58) Field of Classification Search
USPC ..... 49/26, 28
See application file for complete search history.

(56) References Cited

U.S. PATENT DOCUMENTS 6,150,785 A * 11/2000 Butscher ..... H02H 7/0851 318/282
6,274,947 B1 * 8/2001 Terashima ..... H02H 7/0851 307/10.1
6,580,241 B1 * 6/2003 Sugawara ..... H02H 7/0851 318/280
6,906,482 B2 * 6/2005 Shimizu ..... H02H 7/0851 318/286
6,906,487 B2 * 6/2005 de Frutos ..... H02H 7/0851 318/280
7,224,136 B2 * 5/2007 Saitou ..... H02H 7/0851 318/282
7,579,708 B2 * 8/2009 Shibata ..... H02H 7/0851 307/10.1
7,712,256 B2 * 5/2010 Kato ..... E05F 15/46 200/61.43
7,891,139 B2 * 2/2011 Nagakura ..... E05F 17/00 49/24
9,294,031 B2 * 3/2016 Bessho ..... H02H 7/0851
10,047,553 B2 * 8/2018 Shibata ..... E05F 15/41
2004/0124801 A1 * 7/2004 Jurado ..... G05B 13/0265 318/476
2006/0061314 A1 * 3/2006 Shinohara ..... H02H 7/0851 318/466
2009/0295556 A1 * 12/2009 Inoue ..... E05F 15/46 340/438
2011/0210755 A1 * 9/2011 Ogawa ..... H03K 17/955 324/686
2014/0173984 A1 * 6/2014 Schlesiger ..... H02H 7/0851 49/28
2016/0153226 A1 * 6/2016 Aoshima ..... E05F 15/695 49/28
2016/0215553 A1 * 7/2016 Shibata ..... E05F 15/40

FOREIGN PATENT DOCUMENTS

JP 2014-189992 A 10/2014
JP 2014-190043 A 10/2014

OTHER PUBLICATIONS

Written Opinion of the International Searching Authority issued in corresponding application No. PCT/JP2016/001188 dated May 31, 2016 (3 pages).

* cited by examiner (a) WINDOW GLASS CLOSING OPERATION, INITIAL PERIOD OF USE (b) WINDOW GLASS CLOSING OPERATION, AGE DETERIORATION PRESENT (a) WINDOW GLASS CLOSING OPERATION, OCCURRENCE OF PINCHING IN RANGE OTHER THAN SPECIFIC RANGE (b) WINDOW GLASS CLOSING OPERATION, OCCURRENCE OF PINCHING IN SPECIFIC RANGE (a) WINDOW GLASS OPENING OPERATION, INITIAL PERIOD OF USE (b) WINDOW GLASS OPENING OPERATION, AGE DETERIORATION PRESENT (a) WINDOW GLASS OPENING OPERATION, OCCURRENCE OF PINCHING IN RANGE OTHER THAN SPECIFIC RANGE (b) WINDOW GLASS OPENING OPERATION, OCCURRENCE OF PINCHING IN SPECIFIC RANGE

CONTROL DEVICE FOR OPENING AND CLOSING BODIES

TECHNICAL FIELD

The present invention relates to an opening/closing body control device that opens and closes an opening/closing body by driving an actuator, and that detects pinching of a foreign object during an action of the opening/closing body.

BACKGROUND ART

For example, a power window control device is an example of an opening/closing body control device mounted in a vehicle. In the power window control device, a motor is used as an actuator. Further, opening and closing actions of a window glass are caused by rotating the motor normally or in reverse to activate a power window opening/closing mechanism.

In addition, in the power window control device, if pinching of a foreign object in the window is present during a closing action of a window glass, the presence is detected. More specifically, a physical quantity (the movement speed of the window glass, the rotation speed of the motor, the current that flows through the motor, an amount of change in one of the above, or the like) that depends on a drive state of the motor is detected, and the presence or absence of pinching is determined on the basis of a comparison result of the physical quantity and a predetermined threshold value. Further, in a case in which pinching is present, for example, an opening action of the window glass is caused by rotating the motor in reverse or the window glass is brought to rest by stopping the motor, and the foreign object pinched in the window is released.

The detection accuracy of pinching of a foreign object in a window varies depending on the individual characteristics of a motor and other related components. In addition, the detection accuracy of pinching of a foreign object in a window also varies depending on age deterioration of window frame components, and the like, against which the window glass slides. In order to eliminate such effects and stably detect pinching of a foreign object, techniques that correct the physical quantity that depends on the drive state of the motor or update the threshold value for pinching determination have been proposed.

For example, in Patent Document 1, the rotational speed of a motor is measured on the basis of a pulse signal that depends on the rotation of the motor, which is output from a rotation measurement device during a closing action of a window glass, and a difference in rotation speed is calculated on the basis of the rotation speed. Further, the difference in rotation speed is corrected on the basis of learned data stored in a controller, an amount of change in the rotation speed is calculated on the basis of a corrected value, and the presence or absence of pinching is determined from a result of comparing the amount of change and a threshold value for pinching determination. The learned data stored in the controller is updated using a difference in rotation speed calculated for each closing action of the window glass.

In addition, in Patent Document 2, a pulse period is measured from a pulse signal that depends on the rotation of a motor, which is output from a pulse sensor during a closing action of a window glass, and the presence or absence of pinching is determined from a result of comparing the pulse period and a threshold value for pinching determination. In addition, in learning control for updating the threshold value, the threshold value is updated in a case in which a fixed condition such as a difference between the pulse period and the threshold value for pinching determination exceeding an allowable amount of change, a vehicle being stopped, or a door being in a closed state, is satisfied, and the threshold value is not updated in a case in which the fixed condition is not satisfied.

PRIOR ART DOCUMENT(S)

Patent Document(s)

Patent Document 1: Japanese Patent No. 4579757
Patent Document 2: Japanese Patent No. 4573992

SUMMARY OF THE INVENTION

There is a high probability that pinching of a foreign object in a window occurs during performance of a closing action or an opening action of a window glass until a specific range that is dependent on the size of the foreign object with a fully closed position or a fully open position set as a reference of the specific range. In a case in which a foreign object is pinched in a window in the specific range, there is a demand for detecting the pinching with high accuracy, and reducing a load applied to the foreign object, the motor, a mechanism, or the like, by allowing release of the foreign object due to reverse rotation or stopping of the motor. In particular, in a case in which a child's hand or finger is accidentally pinched between a window glass and a window frame, a configuration that reliably detects the pinching, and ensures safety by releasing the hand or finger as a result of reverse rotation or stopping of the motor while preventing a circumstance in which the load applied to the hand or finger becomes excessive is desired.

In addition, in the related art, in the entire movement range of a window glass, measurement data of a physical quantity that depends on the drive state of a motor and a calculated value based on the measurement data are stored in a memory as learned data, and a physical quantity for pinching determination is corrected or a threshold value is updated using the learned data. Therefore, the storage capacity of learned data increases in size, and the processing load of data increases.

One or more embodiments of the present invention provide an opening/closing body control device that detects pinching of a foreign object in an opening/closing body with high accuracy and is capable of reducing the storage capacity and the processing load of learned data.

An opening/closing body control device according to one or more embodiments of the present invention includes: a control unit that controls driving of an actuator configured to cause opening and closing actions of an opening/closing body; a position detection unit that detects an opening/closing position of the opening/closing body; a physical quantity measurement unit that measures a physical quantity that depends on a drive state of the actuator; a storage unit that stores the physical quantity measured by the physical quantity measurement unit and a threshold value; a determination unit that determines the presence or absence of pinching of a foreign object in the opening/closing body on the basis of the physical quantity measured by the physical quantity measurement unit and the threshold value stored in the storage unit; and an update unit that updates the threshold value on the basis of the physical quantity stored in the storage unit, and if the determination unit determines that pinching is present, the control unit reverses a drive direction of the actuator or stops the actuator. According to this configuration, in one or more embodiments of the present invention, the threshold value is updated by the update unit for a specific range of an entire movement range of the opening/closing body, and the threshold value is set to be a preset fixed value for a range other than the specific range.

According to this configuration, during movement of the opening/closing body in the specific range, pinching of a foreign object in the opening/closing body is detected on the basis of a physical quantity measured by the physical quantity measurement unit and an updated (an initial time is not yet updated) threshold value stored in the storage unit. In this case, during opening and closing actions of the opening/closing body, since the physical quantity that depends on the drive state of the actuator is learned and the threshold value in the specific range is updated to match a change trend in the physical quantity, it is possible to detect pinching of a foreign object in the opening/closing body with high accuracy while eliminating the effects of individual characteristics and age deterioration of related components of the opening/closing body. Meanwhile, during movement of the opening/closing body in a range other than the specific range, pinching of a foreign object in the opening/closing body is detected on the basis of a physical quantity measured by the physical quantity measurement unit and a fixed threshold value stored in the storage unit. That is, in one or more embodiments of the present invention, a threshold value for pinching determination is only updated in a specific range, and in a range other than the specific range, a threshold value for pinching determination is not updated and is set to be a fixed value. Therefore, it is possible to reduce the storage capacity and the processing load of learned data for threshold value updating more than a case in which a threshold value is updated throughout the entire movement range of an opening/closing body.

In one or more embodiments of the present invention, according to the opening/closing body control device, the specific range is a range in the vicinity of a fully closed position of the opening/closing body, and the update unit updates the threshold value in the specific range to a value at which the determination unit is more likely to determine the presence of pinching than the threshold value in the range other than the specific range.

In one or more embodiments of the present invention, according to the opening/closing body control device, the specific range is a range in the vicinity of a fully open position of the opening/closing body, and the update unit updates the threshold value in the specific range to a value at which the determination unit is more likely to determine the presence of pinching than the threshold value in the range other than the specific range.

In one or more embodiments of the present invention, the opening/closing body control device further includes a calculation unit that calculates an amount of change in the physical quantity measured by the physical quantity measurement unit, and the determination unit determines the presence or absence of pinching from a comparison result of the amount of change in the physical quantity measured by the calculation unit and the threshold value.

In one or more embodiments of the present invention, for example, the opening/closing body includes a window glass of a vehicle, the actuator includes a motor, and the opening/closing body control device includes a power window control device.

According to one or more embodiments of the present invention, it is possible to provide an opening/closing body control device that detects pinching of a foreign object in an opening/closing body with high accuracy and is capable of reducing the storage capacity and the processing load of learned data.

DETAILED DESCRIPTION OF THE INVENTION

Figure 1:
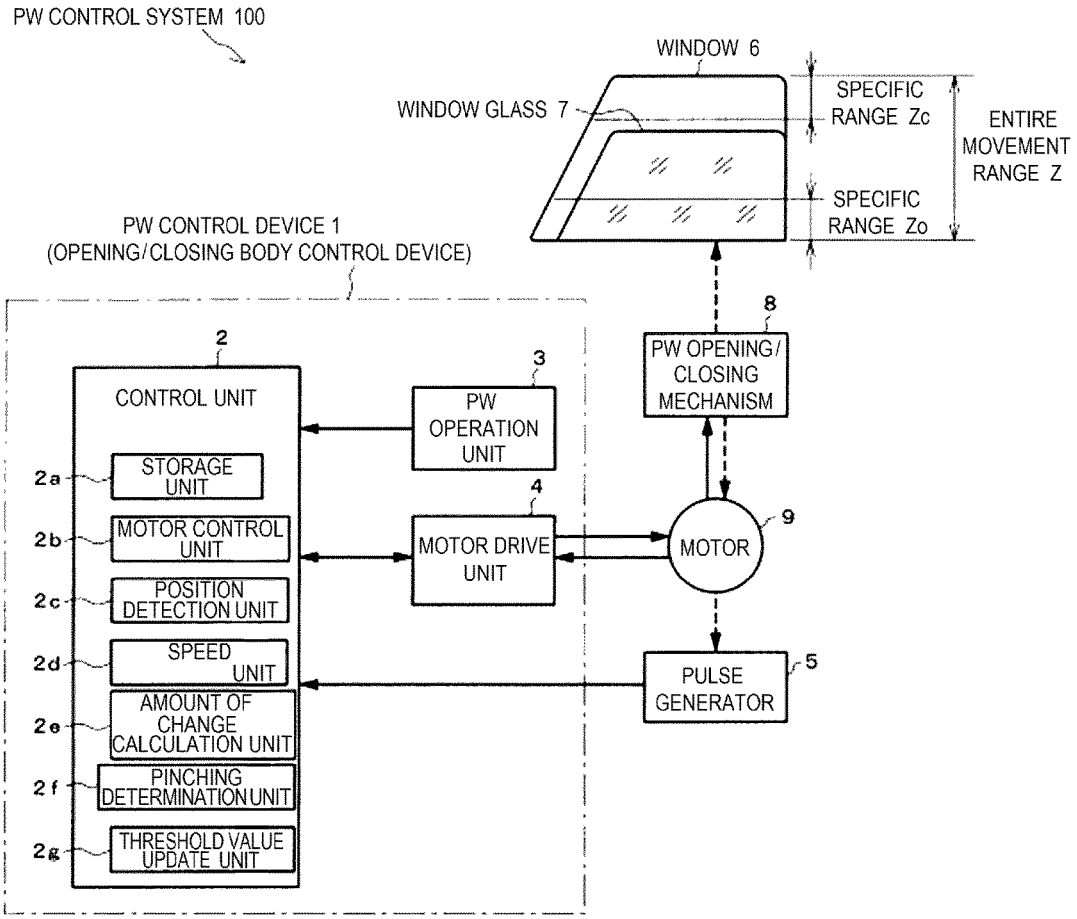
FIG. 1 is a view that shows an example of a PW (power window) control system to which one or more embodiments of the present invention is applied.

Hereinafter, an embodiment of the present invention will be described while referring to the drawings. For each drawing, the same reference symbol is given to identical portions or corresponding portions.

Firstly, a configuration of an embodiment will be described with reference to FIG. 1. Hereinafter, the term "power window" will be written as "PW".

FIG. 1 is a view that shows a configuration of a PW control system 100 and a PW control device 1. The PW control system 100 is mounted in an automobile, and includes the PW control device 1 and constituent elements 5 to 9.

The PW control device 1 drives a motor 9, activates a PW opening/closing mechanism 8, and causes opening and closing actions of a window glass 7 of a window 6 provided in a door of a vehicle. The PW control device 1 is an example of an "opening/closing body control device" according to one or more embodiments of the present invention. The window glass 7 is an example of an "opening/closing body" according to one or more embodiments of the present invention. The motor 9 is an example of an "actuator" according to one or more embodiments of the present invention.

A control unit 2, a PW operation unit 3, and a motor drive unit 4 are provided in the PW control device 1.

The control unit 2 includes a microcomputer and controls opening and closing actions of the window glass 7. A storage unit 2*a*, a motor control unit 2*b*, a position detection unit 2*c*, a speed measurement unit 2*d*, an amount of change calculation unit 2*e*, a pinching determination unit 2*f*, and a threshold value update unit 2*g* are provided in the control unit 2.

The PW operation unit 3 includes a switch for operating the opening and closing actions of the window glass 7 and is provided inside the vehicle. The PW operation unit 3 is operated by a user, and outputs a signal that depends on the operation. The control unit 2 detects an operation state of the PW operation unit 3 on the basis of the signal output from the PW operation unit 3. In the present example, it is possible to perform manual opening and closing operations and automatic opening and closing operations by using the PW operation unit 3.

The motor 9 includes a DC motor. The motor drive unit 4 includes a circuit that drives the motor 9 to rotate normally and in reverse. The motor control unit 2*b* activates the motor drive unit 4 in accordance with an operation state of the PW operation unit 3 and an open/closed state of the window glass 7, and controls a current that flows through the motor 9 by using PWM (pulse width modulation). As a result of this, the motor 9 rotates normally or rotates in reverse, the PW opening/closing mechanism 8 is activated, the window glass 7 is lowered or raised, and the window 6 is opened and closed. The motor control unit 2*b* is an example of "control means" according to one or more embodiments of the present invention.

A pulse generator 5 includes a rotary encoder, for example, and outputs a pulse signal that depends on the rotation state of the motor 9 to the control unit 2. The position detection unit 2*c* detects the pulse signal output from the pulse generator 5, and detects an opening/closing position (a degree of opening of the window 6) of the window glass 7 on the basis of the pulse signal. More specifically, for example, the position detection unit 2*c* counts the number of rises, or the like of the pulse signal output from the pulse generator 5, and determines the opening/closing position of the upper end of the window glass 7 from the count value thereof. The position detection unit 2*c* is an example of "position detection means" according to one or more embodiments of the present invention.

The speed measurement unit 2*d* measures the movement speed of the window glass 7 on the basis of a temporal change in the opening/closing position of the window glass 7, which is detected by the position detection unit 2*c*. The movement speed of the window glass 7 is an example of a physical quantity that depends on the drive state of the motor 9. The amount of change calculation unit 2*e* calculates the amount of change in the movement speed of the window glass 7 measured by the speed measurement unit 2*d*. The speed measurement unit 2*d* is an example of "physical quantity measurement means" according to one or more embodiments of the present invention. The amount of change calculation unit 2*e* is an example of "calculation means" according to one or more embodiments of the present invention.

The pinching determination unit 2*f* determines the presence or absence of pinching of a foreign object in the window 6 on the basis of a comparison result of the amount of change in the movement speed of the window glass 7 calculated by the amount of change calculation unit 2*e* and a predetermined threshold value during opening and closing actions of the window glass 7. The threshold value for pinching determination is stored in the storage unit 2*a*. In addition to the threshold value for pinching determination, detection values of the position detection unit 2*c* and the speed measurement unit 2*d*, a calculated value of the amount of change calculation unit 2*e*, and data for the control unit 2 to control each unit are stored in the storage unit 2*a*. The pinching determination unit 2*f* is an example of "determination means" according to one or more embodiments of the present invention. The storage unit 2*a* is an example of "storage means" according to one or more embodiments of the present invention.

The threshold value update unit 2*g* updates the threshold value for pinching determination stored in the storage unit 2*a* on the basis of the opening/closing position and the amount of change in the movement speed of the window glass 7, which are stored in the storage unit 2*a*. In other words, the opening/closing position and the amount of change in the movement speed of the window glass 7, which are stored in the storage unit 2*a*, are learned data for updating the threshold value for pinching determination. The threshold value update unit 2*g* is an example of "update means" according to one or more embodiments of the present invention.

The threshold value update unit 2*g* updates the threshold value to be compared with the amount of change in the movement speed of the window glass 7 by the pinching determination unit 2*f* (the learned threshold value in FIG. 3, which will be mentioned later) when the upper end of the window glass 7 moves (rises) in a closing direction through a specific range Zc, which, among an entire movement range Z of the window glass 7, is in the vicinity of a fully closed position (the upper end unit of the window 6). In addition, the threshold value update unit 2*g* also updates the threshold value to be compared with the amount of change in the movement speed of the window glass 7 by the pinching determination unit 2*f* (the learned threshold value in FIG. 6, which will be mentioned later) when the upper end of the window glass 7 moves (is lowered) in an opening direction through a specific range Zo, which is in the vicinity of a fully open position (the lower end unit of the window 6).

Figure 3:
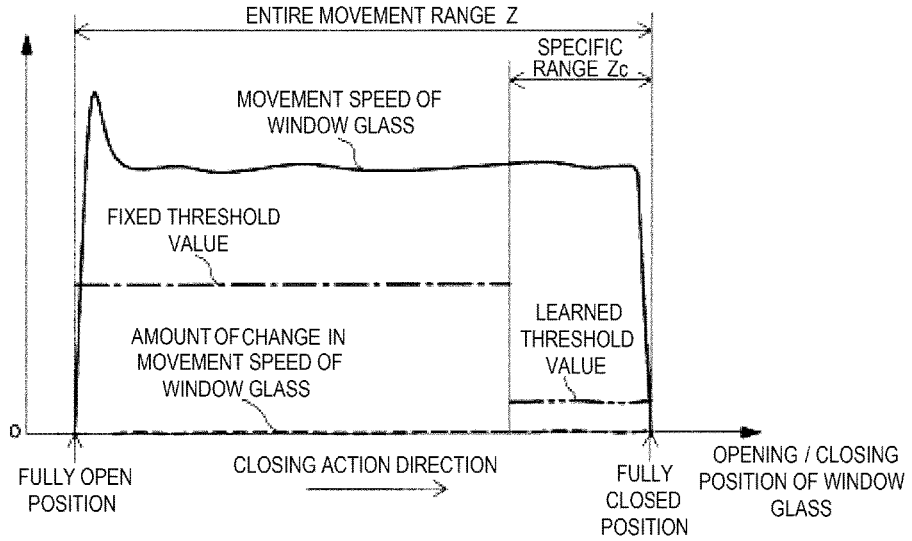
FIG. 3 is a view that shows an example of changes in an opening/closing position and a movement speed of a window glass in a case of closing the window.
Figure 3:
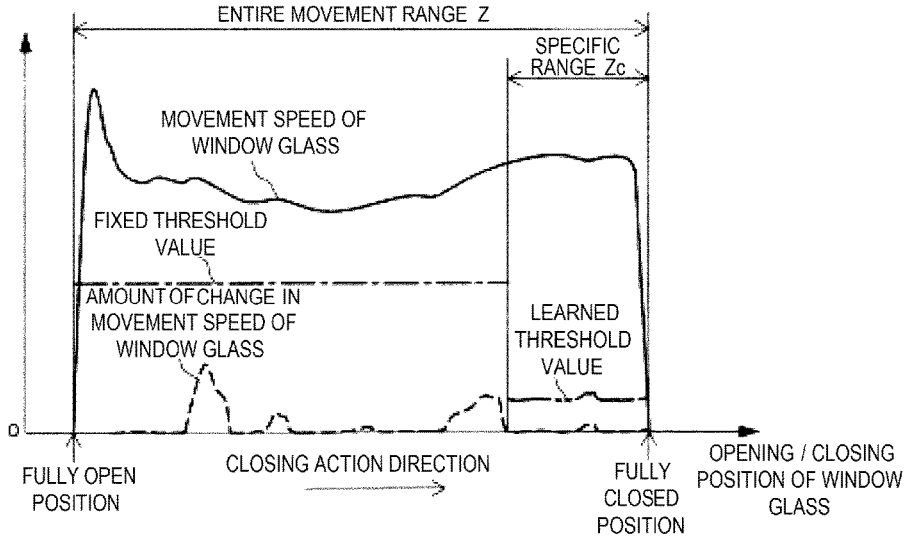

Meanwhile, when the upper end of the window glass 7 moves (rises) in the closing direction through a range other than the specific range Zc (including the specific range Zo), the threshold value to be compared with the amount of change in the movement speed of the window glass 7 by the pinching determination unit 2*f* is not updated by the threshold value update unit 2*g*, and is set to be a fixed value that is set in advance and stored in the storage unit 2*a* (the fixed threshold value in FIG. 3, which will be mentioned later). In addition, when the upper end of the window glass 7 moves (is lowered) in the opening direction through a range other than the specific range Zo (including the specific range Zc) in the vicinity of the fully open position, the threshold value to be compared with the amount of change in the movement speed of the window glass 7 by the pinching determination unit 2*f* is not updated by the threshold value update unit 2*g*, and is set to be a fixed value that is set in advance and stored in the storage unit 2*a* (the fixed threshold value in FIG. 6, which will be mentioned later).

Hereinafter, actions of the PW control device 1 will be described while referring to FIGS. 2 to 7. In addition, the description will also refer to FIG. 1 where appropriate.

Figure 2:
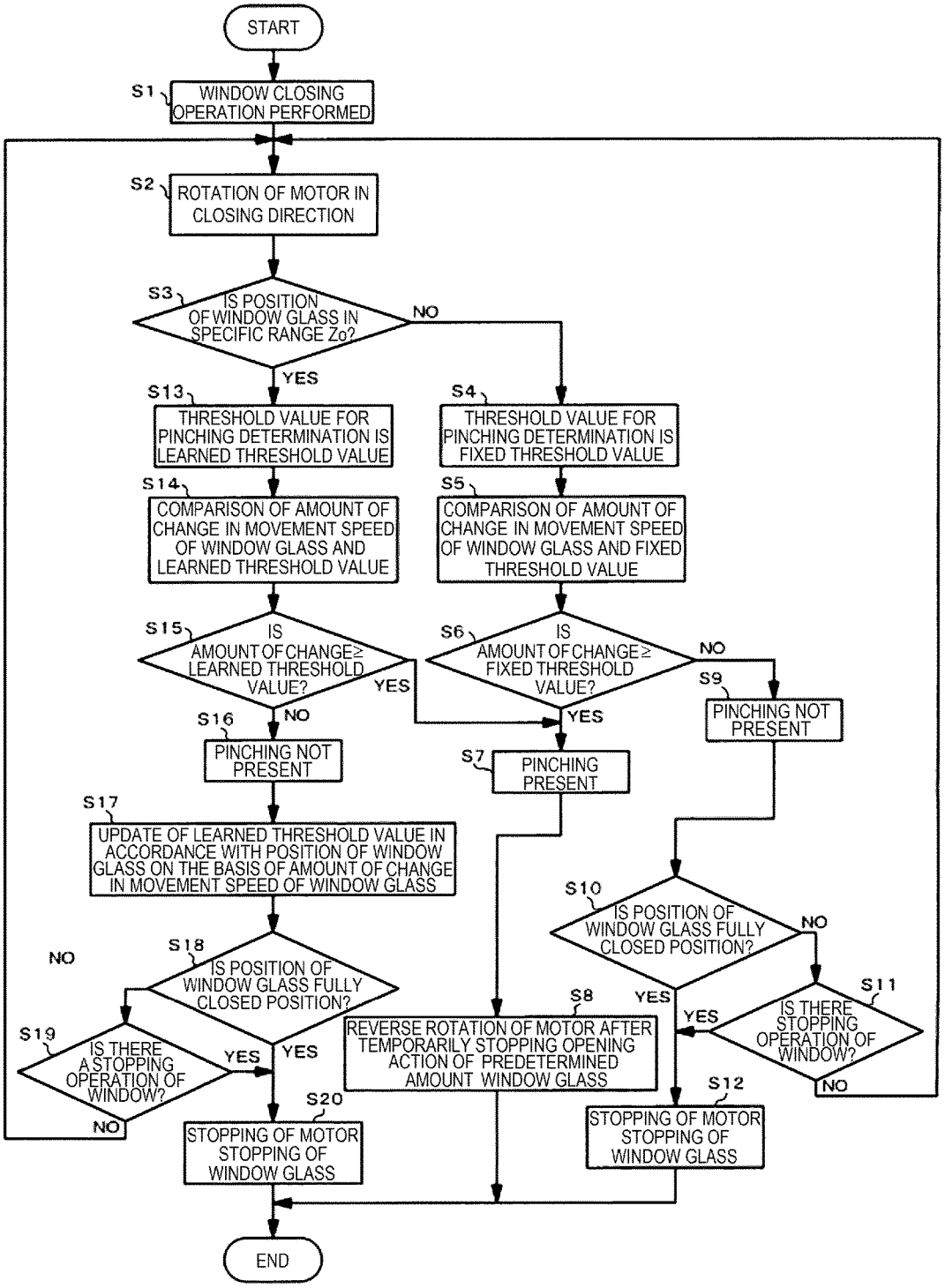
FIG. 2 is a flowchart that shows actions of a PW control device in a case of closing a window.
Figure 4:
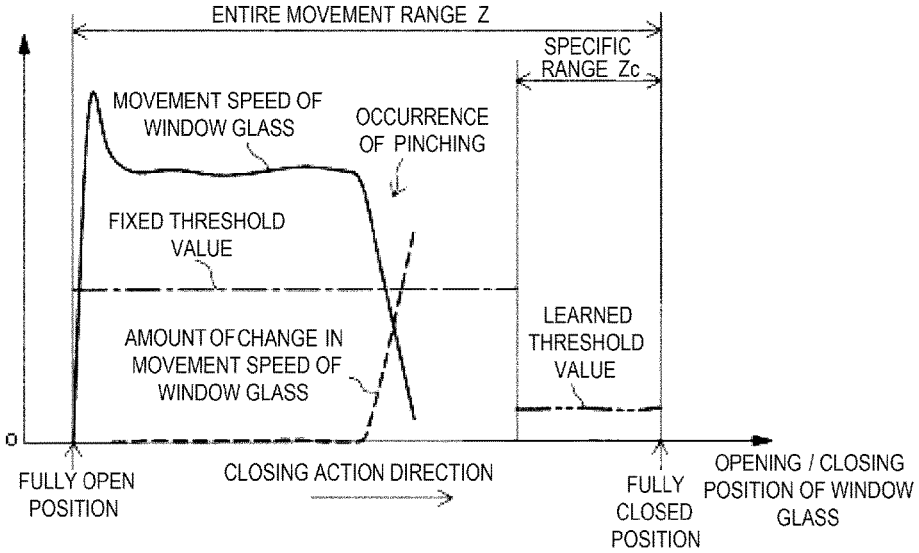
FIG. 4 is a view that shows an example of changes in the opening/closing position and the movement speed of the window glass in a case in which a foreign object is pinched in the window during closing of the window.
Figure 4:
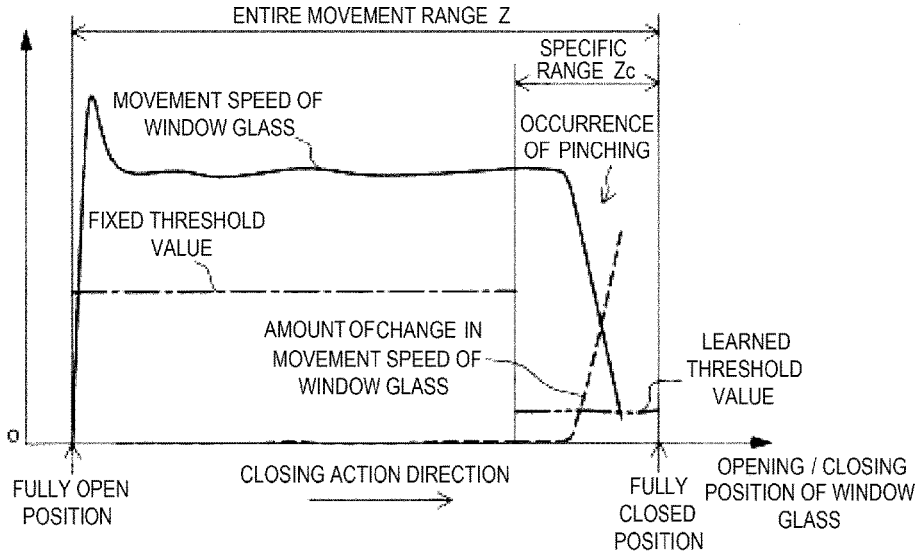

Firstly, actions in a case of closing the window 6 will be described. FIG. 2 is a flowchart that shows actions of the PW control device 1 in a case of closing the window 6. FIG. 3 is a view that shows an example of changes in the opening/closing position and the movement speed (the rising speed) of the window glass 7 in a case of closing the window 6. FIG. 4 is a view that shows an example of changes in the opening/closing position and the movement speed of the window glass 7 in a case in which a foreign object is pinched during closing of the window 6.

When a user performs an automatic closing operation or a manual closing operation by using the PW operation unit 3, the control unit 2 determines that a closing operation of a window is performed (Step S1 in FIG. 2). When this occurs, the motor control unit 2*b* activates the motor drive unit 4, causes the motor 9 to rotate in the closing direction, and causes a closing action of the window glass 7 (Step S2 in FIG. 2).

Since an inrush current flows through the motor 9 immediately after the window glass 7 starts a closing action, as shown in FIGS. 3(*a*) and 3(*b*), the movement speed (the solid line) of the window glass 7 rises rapidly and then immediately falls. The amount of change calculation unit 2*e* calculates the amount of change in the movement speed of the window glass 7 in a predetermined interval so as to avoid erroneous determination of pinching due to the sudden fluctuation in the movement speed of the window glass 7 immediately after starting an action. In other words, the amount of change in the movement speed of the window glass 7 is calculated in a time interval during which the sudden fluctuation in the movement speed of the window glass 7 immediately after starting an action is disregarded.

A short while after starting an action, the movement speed of the window glass 7 reaches a certain speed as a result of the motor control unit 2*b* controlling driving of the motor 9 via the motor drive unit 4. Further, in a case of an initial period of use in which there is no age deterioration of the window frame components, and the like, against which the window glass 7 slides, as shown in FIG. 3(*a*), the movement speed of the window glass 7 transitions in a substantially constant manner. In contrast to this, in a case in which age deterioration of the window frame components, and the like, has occurred, as shown in FIG. 3(*b*), even if the motor control unit 2*b* controls the driving of the motor 9, the movement speed of the window glass 7 fluctuates in an unstable manner due to friction resistance of the window glass 7 with the window frame components, and the like.

Until the opening/closing position of the window glass 7, which is detected by the position detection unit 2*c*, enters the specific range Zc in the vicinity of the fully closed position (Step S3 in FIG. 2: NO), the threshold value for pinching determination is a constant fixed value (hereinafter, referred to as a "fixed threshold value") that is set in advance (Step S4 in FIG. 2, dashed-dotted line in FIG. 3). Therefore, the pinching determination unit 2*f* compares the amount of change in the movement speed of the window glass 7 calculated by the amount of change calculation unit 2*e* with the fixed threshold value (Step S5 in FIG. 2).

Further, when a foreign object is pinched between the upper frame of the window 6 and the upper end of the window glass 7, for example, during the closing action of the window glass 7 in a range other than the specific range Zc, as shown in FIG. 4(*a*), the movement speed of the window glass 7 is reduced, and the amount of change in the movement speed of the window glass 7 (the broken line) becomes greater than or equal to the fixed threshold value (Step S6 in FIG. 2: YES). When this occurs, the pinching determination unit 2*f* determines that pinching of a foreign object in the window 6 is present (Step S7 in FIG. 2). In this case, the motor control unit 2*b* temporarily stops and subsequently rotates the motor 9 in reverse (rotates in the opening direction) by using the motor drive unit 4, and causes an opening action of a predetermined amount of the window glass 7 (Step S8 in FIG. 2). As a result of this, the foreign object pinched in the window 6 is released.

Meanwhile, if a foreign object is not pinched between the window 6 and the window glass 7 during the closing action of the window glass 7 in a range other than the specific range Zc, as shown in FIG. 3, the amount of change in the movement speed of the window glass 7 (the broken line) is less than the fixed threshold value (Step S6 in FIG. 2: NO). In this case, the pinching determination unit 2*f* determines that pinching of a foreign object in the window 6 is not present (Step S9 in FIG. 2). Thereafter, the closing action of the window glass 7 is continued (Step S2 in FIG. 2) in a case in which the opening/closing position of the window glass 7, which is detected by the position detection unit 2*c*, has not reached the fully closed position (Step S10 in FIG. 2: NO), or in a case in which there is not a stopping operation of the window in the PW operation unit 3 (Step S11 in FIG. 2: NO).

In addition, the motor control unit 2*b* stops the motor 9 by using the motor drive unit 4 and stops the window glass 7 (Step S12 in FIG. 2) in a case in which the opening/closing position of the window glass 7 has reached the fully closed position (Step S10 in FIG. 2: YES) in a state in which pinching of a foreign object in the window 6 is not present (Step S9 in FIG. 2), or in a case in which there is a stopping operation of the window (Step S11 in FIG. 2: YES).

On the other hand, when the opening/closing position of the window glass 7 enters the specific range Zc in the vicinity of the fully closed position (Step S3 in FIG. 2: YES), the threshold value for pinching determination becomes a learned value (hereinafter, referred to as a "learned threshold value") that is updated by the threshold value update unit 2*g* (Step S13 in FIG. 2, dashed-two dotted line in FIG. 3). The learned threshold value is not a constant value since the value is updated in accordance with the amount of change in the movement speed of the window glass 7, which is calculated by the amount of change calculation unit 2*e*. Therefore, the pinching determination unit 2*f* compares the amount of change in the movement speed of the window glass 7 calculated by the amount of change calculation unit 2*e* with the learned threshold value (Step S14 in FIG. 2).

Further, when a foreign object is pinched between the upper frame of the window 6 and the upper end of the window glass 7, for example, during the closing action of the window glass 7 in the specific range Zc, as shown in FIG. 4(*b*), the movement speed of the window glass 7 is reduced, and the amount of change in the movement speed of the window glass 7 (the broken line) becomes greater than or equal to the learned threshold value (Step S15 in FIG. 2: YES). When this occurs, the pinching determination unit 2*f* determines that pinching of a foreign object in the window 6 is present (Step S7 in FIG. 2). In this case, the motor control unit 2*b* temporarily stops and subsequently rotates the motor 9 in reverse (rotates in the opening direction) by using the motor drive unit 4, and causes an opening action of a predetermined amount of the window glass 7 (Step S8 in FIG. 2). As a result of this, the foreign object pinched in the window 6 is released.

Meanwhile, if a foreign object is not pinched between the window 6 and the window glass 7 during the closing action of the window glass 7 in the specific range Zc, as shown in FIG. 3, the amount of change in the movement speed of the window glass 7 (the broken line) is less than the learned threshold value (Step S15 in FIG. 2: NO). In this case, the pinching determination unit 2*f* determines that pinching of a foreign object in the window 6 is not present (Step S16 in FIG. 2). Further, the threshold value update unit 2*g* updates the learned threshold value in accordance with the current position of the window glass 7 on the basis of the amount of change in the movement speed of the window glass 7 (Step S17 in FIG. 2). More specifically, for example, the threshold value update unit 2*g* sets a value obtained by adding a predetermined correction value to the amount of change in the movement speed of the window glass 7 calculated by the amount of change calculation unit 2*e* as a new learned threshold value. Further, a learned threshold value that depends on the current position of the window glass 7, which is stored in the storage unit 2*a*, is overwritten with the new learned threshold value. As shown in FIG. 3, the learned threshold value is set to be a low value at which it is more likely that the presence of pinching will be determined than the fixed threshold value.

Thereafter, the closing action of the window glass 7 is continued (Step S2 in FIG. 2) in a case in which the opening/closing position of the window glass 7, which is detected by the position detection unit 2*c*, has not reached the fully closed position (Step S18 in FIG. 2: NO), or in a case in which there is not a stopping operation of the window (Step S19 in FIG. 2: NO).

In addition, the motor control unit 2*b* stops the motor 9 by using the motor drive unit 4 and stops the window glass 7 (Step S20 in FIG. 2) in a case in which the opening/closing position of the window glass 7 has reached the fully closed position (Step S18 in FIG. 2: YES) in a state in which pinching of a foreign object in the window 6 is not present (Step S16 in FIG. 2), or in a case in which there is a stopping operation of the window (Step S19 in FIG. 2: YES).

Figure 5:
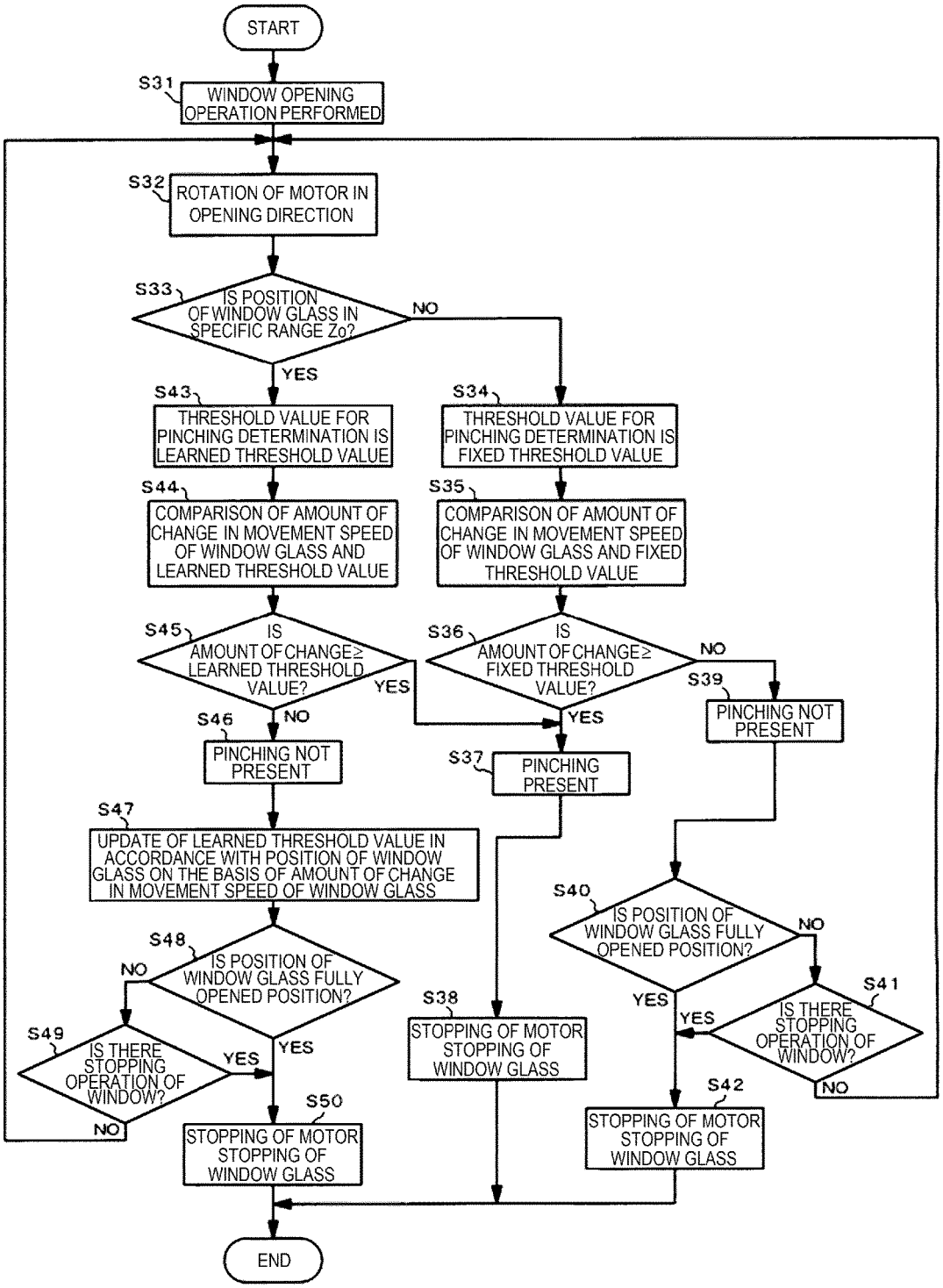
FIG. 5 is a flowchart that shows actions of the PW control device in a case of opening the window.
Figure 6:
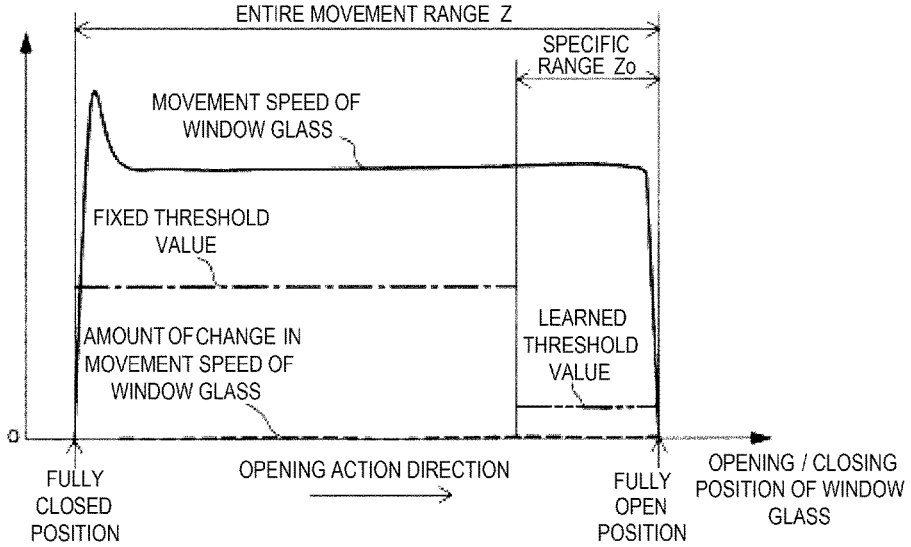
FIG. 6 is a view that shows an example of changes in the opening/closing position and the movement speed of the window glass in a case of opening the window.
Figure 6:
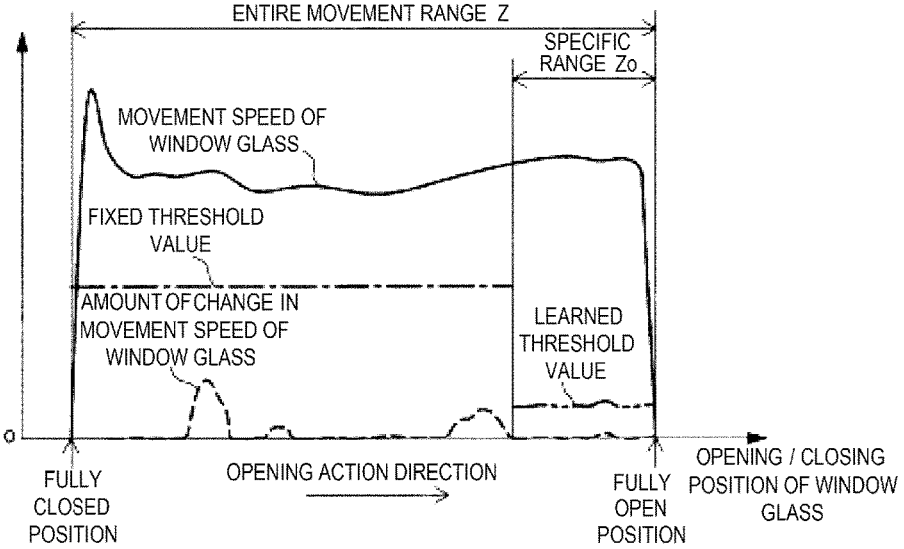
Figure 7:
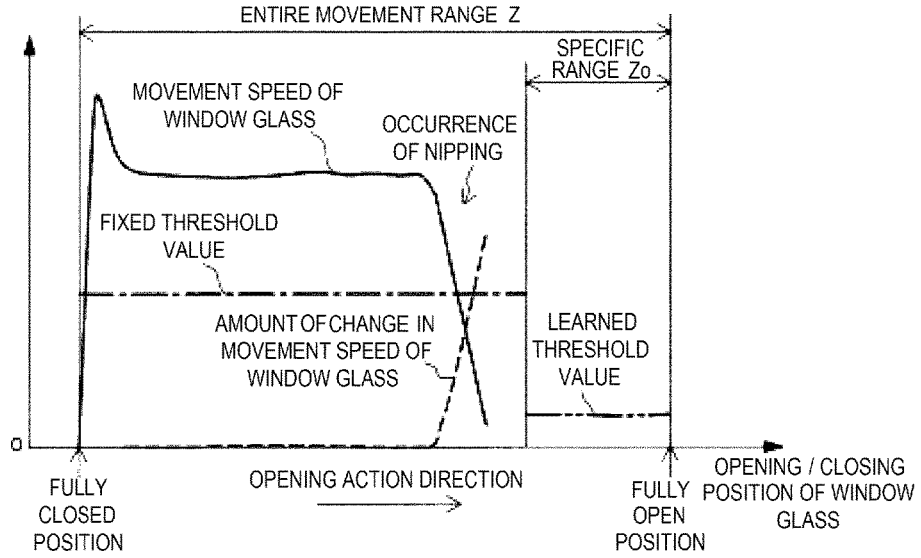
FIG. 7 is a view that shows an example of changes in the opening/closing position and the movement speed of the window glass in a case in which a foreign object is pinched in the window during opening of the window.
Figure 7:
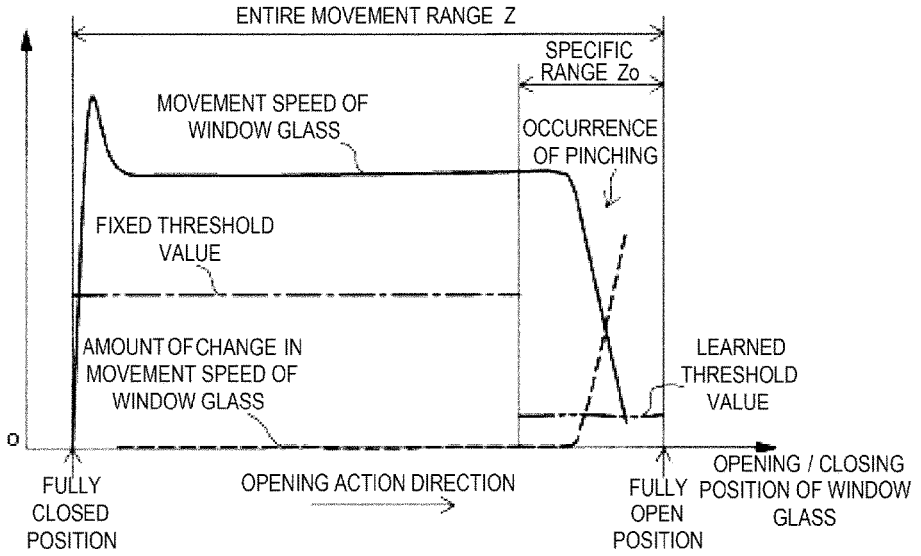

Next, actions in a case of opening the window 6 will be described. FIG. 5 is a flowchart that shows actions of the PW control device 1 in a case of opening the window 6. FIG. 6 is a view that shows an example of changes in the opening/closing position and the movement speed (the lowering speed) of the window glass 7 in a case of opening the window 6. FIG. 7 is a view that shows an example of changes in the opening/closing position and the movement speed of the window glass 7 in a case in which a foreign object is pinched during opening of the window 6.

When a user performs an automatic opening operation or a manual opening operation by using the PW operation unit 3, the control unit 2 determines that an opening operation of a window is performed (Step S31 in FIG. 5). When this occurs, the motor control unit 2*b* activates the motor drive unit 4, causes the motor 9 to rotate in the opening direction, and causes an opening action of the window glass 7 (Step S32 in FIG. 5).

Since an inrush current flows through the motor 9 immediately after the window glass 7 starts an opening action, as shown in FIGS. 6(*a*) and 6(*b*), the movement speed (the solid line) of the window glass 7 rises rapidly and then immediately falls. The amount of change calculation unit 2*e* calculates the amount of change in the movement speed of the window glass 7 in a predetermined interval so as to avoid erroneous determination of pinching due to the sudden fluctuation in the movement speed of the window glass 7 immediately after starting an action (in a similar manner to the closing action).

A short while after starting an action, the movement speed of the window glass 7 reaches a certain speed as a result of the motor control unit 2*b* controlling driving of the motor 9 via the motor drive unit 4. Further, in a case of an initial period of use in which there is no age deterioration of the window frame components, and the like, as shown in FIG. 6(*a*), the movement speed of the window glass 7 transitions in a substantially constant manner. In contrast to this, in a case in which age deterioration of the window frame components, and the like, has occurred, as shown in FIG. 6(*b*), even if the motor control unit 2*b* controls the driving of the motor 9, the movement speed of the window glass 7 fluctuates in an unstable manner due to friction resistance of the window glass 7 with the window frame components, and the like.

Until the opening/closing position of the window glass 7, which is detected by the position detection unit 2*c*, enters the specific range Zo in the vicinity of the fully open position (Step S33 in FIG. 5: NO), the threshold value for pinching determination is a fixed threshold value that is set in advance (Step S34 in FIG. 5, dashed-dotted line in FIG. 6). The fixed threshold value is a fixed threshold value for the opening action, and is different from the above-mentioned fixed threshold value for the closing action. The pinching determination unit 2*f* compares the amount of change in the movement speed of the window glass 7 calculated by the amount of change calculation unit 2*e* with the fixed threshold value (Step S35 in FIG. 5).

Further, when a foreign object is pinched between the glass surface of the window glass 7 and the lower frame of the window 6, for example, during the opening action of the window glass 7 in a range other than the specific range Zo, as shown in FIG. 7(*a*), the movement speed of the window glass 7 is reduced, and the amount of change in the movement speed of the window glass 7 (the broken line) becomes greater than or equal to the fixed threshold value (Step S36 in FIG. 5: YES). When this occurs, the pinching determination unit 2*f* determines that pinching of a foreign object in the window 6 is present (Step S37 in FIG. 5). In this case, the motor control unit 2*b* stops the motor 9 by using the motor drive unit 4, and stops the window glass 7 (Step S38 in FIG. 5). As a result of this, the foreign object pinched in the window 6 can be released (removed).

Meanwhile, if a foreign object is not pinched between the window glass 7 and the window 6 during the opening action of the window glass 7 in a range other than the specific range Zo, as shown in FIG. 6, the amount of change in the movement speed of the window glass 7 (the broken line) is less than the fixed threshold value (Step S36 in FIG. 5: NO). In this case, the pinching determination unit 2*f* determines that pinching of a foreign object in the window 6 is not present (Step S39 in FIG. 5). Thereafter, the opening action of the window glass 7 is continued (Step S32 in FIG. 5) in a case in which the opening/closing position of the window glass 7, which is detected by the position detection unit 2*c*, has not reached the fully open position (Step S40 in FIG. 5: NO), or in a case in which there is not a stopping operation of the window in the PW operation unit 3 (Step S41 in FIG. 5: NO).

In addition, the motor control unit 2*b* stops the motor 9 by using the motor drive unit 4 and stops the window glass 7 (Step S42 in FIG. 5) in a case in which the opening/closing position of the window glass 7 has reached the fully open position (Step S40 in FIG. 5: YES) in a state in which pinching of a foreign object in the window 6 is not present (Step S39 in FIG. 5), or in a case in which there is a stopping operation of the window (Step S41 in FIG. 5: YES).

On the other hand, when the opening/closing position of the window glass 7 enters the specific range Zo in the vicinity of the fully open position (Step S33 in FIG. 5: YES), the threshold value for pinching determination becomes a learned threshold value that is updated by the threshold value update unit 2*g* (Step S43 in FIG. 5, dashed-two dotted line in FIG. 6). The learned threshold value is a learned threshold value for the opening action, and is different from the above-mentioned learned threshold value for the closing action. The pinching determination unit 2*f* compares the amount of change in the movement speed of the window glass 7 calculated by the amount of change calculation unit 2*e* with the learned threshold value (Step S44 in FIG. 5).

Further, when a foreign object is pinched between the glass surface of the window glass 7 and the lower frame of the window 6, during the opening action of the window glass 7 in the specific range Zo, as shown in FIG. 6(*b*), the movement speed of the window glass 7 is reduced, and the amount of change in the movement speed of the window glass 7 (the broken line) becomes greater than or equal to the learned threshold value (Step S45 in FIG. 5: YES). When this occurs, the pinching determination unit 2*f* determines that pinching of a foreign object in the window 6 is present (Step S37 in FIG. 5). In this case, the motor control unit 2*b* stops the motor 9 by using the motor drive unit 4, and stops the window glass 7 (Step S38 in FIG. 5). As a result of this, the foreign object pinched in the window 6 can be released.

Meanwhile, if a foreign object is not pinched between the window glass 7 and the window 6 during the opening action of the window glass 7 in the specific range Zo, as shown in FIG. 6, the amount of change in the movement speed of the window glass 7 (the broken line) is less than the learned threshold value (Step S45 in FIG. 5: NO). In this case, the pinching determination unit 2*f* determines that pinching of a foreign object in the window 6 is not present (Step S46 in FIG. 5). Further, the threshold value update unit 2*g* updates the learned threshold value in accordance with the current position of the window glass 7 on the basis of the amount of change in the movement speed of the window glass 7 (Step S47 in FIG. 5). At this time, for example, the learned threshold value is updated by using a similar method to the case of closing the window glass 7.

Thereafter, the opening action of the window glass 7 is continued (Step S32 in FIG. 5) in a case in which the opening/closing position of the window glass 7, which is detected by the position detection unit 2*c*, has not reached the fully open position (Step S48 in FIG. 5: NO), or in a case in which there is not a stopping operation of the window (Step S49 in FIG. 5: NO).

In addition, the motor control unit 2*b* stops the motor 9 by using the motor drive unit 4 and stops the window glass 7 (Step S50 in FIG. 5) in a case in which the opening/closing position of the window glass 7 has reached the fully open position (Step S48 in FIG. 5: YES) in a state in which pinching of a foreign object in the window 6 is not present (Step S46 in FIG. 5), or in a case in which there is a stopping operation of the window (Step S49 in FIG. 5: YES).

According to the above-mentioned embodiment, during movement of the window glass 7 in the specific ranges Zo, Zc, pinching of a foreign object in the window 6 is detected on the basis of the amount of change in the movement speed of the window glass 7, which is calculated by the amount of change calculation unit 2*e*, and an updated (an initial time is not yet updated) learned threshold value stored in the storage unit 2*a*. In this case, during opening and closing actions of the window glass 7, the amount of change in the movement speed of the window glass 7 is learned, and the learned threshold values of the specific ranges Zo, Zc are updated to match change trends in the movement speed (FIG. 3 and FIG. 6). Therefore, it is possible to detect pinching of a foreign object in the window 6 with high accuracy while eliminating the effects of individual characteristics and age deterioration of related components of a power window. Meanwhile, during movement of the window glass 7 in ranges other than the specific ranges Zo, Zc, pinching of a foreign object in the window 6 is detected on the basis of the amount of change in the movement speed of the window glass 7, which is calculated by the amount of change calculation unit 2*e*, and a constant fixed threshold value stored in the storage unit 2*a*.

That is, in the above-mentioned embodiment, a threshold value for pinching determination is only updated in the specific ranges Zo, Zc, and in ranges other than the specific ranges, a threshold value for pinching determination is not updated and is set to be a fixed value. Therefore, it is possible to reduce the storage capacity and the processing load of learned data for threshold value updating more than a case in which a threshold value is updated throughout the entire movement range of the window glass 7.

In addition, in the above-mentioned embodiment, the specific range Zc is a range in the vicinity of the fully closed position of the window glass 7, and the specific range Zo is a range in the vicinity of the fully open position of the window glass 7. Further, the threshold value update unit 2*g* updates the learned threshold values used in the specific ranges Zc, Zo to low values at which it is more likely that the presence of pinching will be determined than the fixed threshold value used in ranges other than the specific ranges. Therefore, during opening and closing actions of the window glass 7, it is possible to improve the detection sensitivity of pinching of a foreign object in the window 6 more in the specific ranges Zo, Zc than in the ranges other than the specific ranges. Further, when pinching is detected in the specific ranges Zo, Zc, the motor 9 is immediately stopped or rotated in reverse, the foreign object is released, and therefore, it is possible to reduce a load applied to the foreign object, the motor 9, the PW opening/closing mechanism 8, or another component.

In particular, in a case in which a child's hand or finger is accidentally pinched between the window glass 7 and a window frame during a closing action of the window glass 7 in the specific range Zc in the vicinity of the fully closed position, it is possible to rapidly detect the pinching, and release the hand or finger by immediately rotating the motor 9 in reverse. In other words, a load applied to the child's hand or finger prior to the motor 9 being rotated in reverse is reduced to a small load, and it is possible to ensure safety.

The present invention can adopt various embodiments in addition to that mentioned above. For example, in the above-mentioned embodiment, an example in which the movement speed of the window glass 7 is detected as a physical quantity that represents the drive state of the actuator (the motor 9) was shown, but one or more embodiments of the present invention are not solely limited to this configuration. In addition to this, for example, the rotation speed of the motor 9, the current that flows through the motor 9, the load of the motor 9, or the like, may also be detected as the physical quantity according to one or more embodiments of the present invention. Further, the presence or absence of pinching may be determined by comparing any one of the above-mentioned physical quantities or an amount of change thereof with a threshold value for pinching determination.

Additionally, a motor current that flows through the motor 9 can be detected by providing a current detection circuit that includes a shunt resistance and a CR low-pass filter, for example, in the motor drive unit 4. In addition, ripples included in a detected motor current may be extracted and the opening/closing position of the window glass 7 may be detected on the basis of the ripples.

In addition, in the above-mentioned embodiment, an example in which the learned threshold values that depend on the position of the window glass 7 at that time are updated immediately after it is determined that pinching is not present in the specific ranges Zo, Zc, is shown, but one or more embodiments of the present invention are not solely limited to this configuration. In addition to this, for example, the learned threshold values may be updated collectively after the window glass 7 reaches the fully closed position or the fully open position.

In addition, in the above-mentioned embodiment, an example in which a new learned threshold value is calculated by adding a predetermined correction value to the amount of change in the movement speed of the window glass 7 is shown, but one or more embodiments of the present invention are not solely limited to this configuration, and a new learned threshold value may also be calculated by using a calculation method other than this. In addition, a new learned threshold value may be set by learning from the movement speed of the window glass 7 or a trend in data such as an amount of change in the movement speed that was stored in the storage unit 2*a* during the previous N (N is an integer of 1 or more) occasions of opening and closing of the window glass 7.

In addition, in the above-mentioned embodiment, an example in which the motor 9 is temporarily stopped and subsequently rotated in reverse in a case in which pinching is detected during a closing action of the window glass 7, and the motor 9 is stopped in a case in which pinching is detected during an opening action of the window glass 7 is shown, but one or more embodiments of the present invention are not solely limited to this configuration. In addition to this, the motor may be temporarily stopped and subsequently rotated in reverse in a case in which pinching is detected during an opening action of the window glass. In addition, the motor may be stopped in a case in which pinching is detected during a closing action of the window glass.

In addition, in the above-mentioned embodiment, an example in which the presence or absence of pinching is detected and the learned threshold value is updated during both a closing action and an opening action of the window glass 7 is shown, but one or more embodiments of the present invention are not solely limited to this configuration. The presence or absence of pinching may be detected and the learned threshold value may be updated during either one of a closing action or an opening action of the window glass.

In addition, in the above-mentioned embodiment, the motor 9 is included as an example of an actuator, but one or more embodiments of the invention are not solely limited to this configuration. For example, a solenoid, or the like, may also be used as an actuator.

Furthermore, in the above-mentioned embodiment, an example in which the present invention is applied to the PW control device 1 of an automobile is shown, but the invention is not limited to this configuration. One or more embodiments of the present invention may also be applied to vehicle opening/closing body control devices and opening/closing body control devices in applications other than vehicles such as an electric opening/closing roof, for example.

DESCRIPTION OF REFERENCE NUMERALS

1: PW (power window) control device (opening/closing body control device)
2*a*: storage unit (storage means)
2*b*: motor control unit (control means)
2*c*: position detection unit (position detection means)
2*d*: speed measurement unit (physical quantity measurement means)
2*e*: amount of change calculation unit (calculation means)
2*f*: pinching determination unit (determination means)
2*g*: threshold value update unit (update means)
6: window
7: window glass (opening/closing body)
9: motor (actuator)
Z: entire movement range
Zc: specific range in vicinity of the fully closed position
Zo: specific range in vicinity of the fully open position

The invention claimed is:

1. An opening and closing body control device comprising:

a control unit that controls driving of an actuator configured to cause opening and closing actions of an opening and closing body;

a position detection unit that detects an opening/closing position of the opening and closing body;

a physical quantity measurement unit that measures a physical quantity that depends on a drive state of the actuator;

a storage unit that stores the physical quantity measured by the physical quantity measurement unit and a threshold value;

a determination unit that determines presence or absence of pinching of a foreign object in the opening and closing body on the basis of the physical quantity measured by the physical quantity measurement unit and the threshold value stored in the storage unit; and an update unit that updates the threshold value on the basis of the physical quantity stored in the storage unit, wherein if the determination unit determines that pinching is present, the control unit reverses a drive direction of the actuator or stops the actuator, wherein the threshold value is updated by the update unit for a specific range of an entire movement range of the opening and closing body, and wherein the threshold value is set to be a preset fixed value for a range other than the specific range.

2. The opening and closing body control device according to claim 1, wherein the specific range is a range in the vicinity of a fully closed position of the opening and closing body, and wherein the update unit updates the threshold value in the specific range to a value at which the determination unit is more likely to determine the presence of pinching than the threshold value in the range other than the specific range.

3. The opening and closing body control device according to claim 1, wherein the specific range is a range in the vicinity of a fully open position of the opening and closing body, and wherein the update unit updates the threshold value in the specific range to a value at which the determination unit is more likely to determine the presence of pinching than the threshold value in the range other than the specific range.

4. The opening and closing body control device according to claim 1, further comprising:

a calculation unit that calculates an amount of change in the physical quantity measured by the physical quantity measurement unit, wherein the determination unit determines the presence or absence of pinching from a comparison result of the amount of change in the physical quantity measured by the calculation unit and the threshold value.

5. The opening and closing body control device according to claim 1, wherein the opening and closing body comprises a window glass of a vehicle, wherein the actuator comprises a motor, and wherein the opening and closing body control device comprises a power window control device.

* * * * *